US006006447A

United States Patent [19]

Neal et al.

[11] Patent Number: 6,006,447

[45] Date of Patent: Dec. 28, 1999

[54] SHOE INSOLE WITH AIR CIRCULATION SYSTEM

[76] Inventors: James R. Neal, 875 William Blvd., Apt. 2413, Jackson, Miss. 39157; Estella B. Lindsay, 3533 Bailey Ave. Extension, Jackson, Miss. 39213

[21] Appl. No.: 09/296,548

[22] Filed: Apr. 22, 1999

[51] Int. Cl.[6] ..... A43B 7/06

[52] U.S. Cl. ..... 36/3 B; 36/3 R; 36/44

[58] Field of Search ..... 36/3 R, 3 B, 43, 36/44

[56] References Cited

U.S. PATENT DOCUMENTS

| | | | |
|---|---|---|---|
| 230,273 | 7/1880 | Hannaford | 36/3 R |
| 455,847 | 7/1891 | Howard et al. | 36/3 R |
| 655,576 | 8/1900 | Pearson | 36/3 R |
| 2,451,929 | 10/1948 | Dorgin | 36/3 B |
| 3,426,455 | 2/1969 | Drago | 36/3 R |
| 3,716,930 | 2/1973 | Brahm | 36/3 B |

*Primary Examiner*—M. D. Patterson

*Attorney, Agent, or Firm*—George L. Williamson

[57] ABSTRACT

The present invention discloses a device for a shoe insole having multiple layers which form an air circulation system. A first layer is a fabric-like covering; a non-deformable second and deformable third layers forming together a layer with a cavity therein having offset apertures therein communicating by means of the cavity positioned underneath the fabric-like covering; a fourth layer made of foam rubber like material that deflates under the user's weight and re-expands when not under the user's weight; a bottom layer being a stiffer layer that forms a recess for receiving the other layers. A first and second exhaust conduit is formed in a side extension area for outward passage of stale air. The layers are joined to each other and the device is then inserted into the shoe of the user. The weight of the user is alternatively placed on and removed from the insole while walking or running. When the weight of the user is on the insole it compresses and stale air is forced out the exhaust conduit. When the weight of the user is removed from the insole, the foam rubber layer seeks to expand and therefore creates a vacuum which pulls air through the apertures of the second and third layers as the deformable third layer is deposed toward the foam rubber layer.

13 Claims, 2 Drawing Sheets

SHOE INSOLE WITH AIR CIRCULATION SYSTEM

BACKGROUND OF THE INVENTION

1. Field of the Invention

The present invention relates generally to shoe insoles and, more particularly, is concerned with insoles for shoes having air circulation systems in order to reduce the odor of the shoes.

2. Description of the Prior Art

Shoe insole systems have been described in the prior art. However, none of the prior art devices disclose the unique features of the present invention.

In U.S. Pat. No. 4,071,963, dated Feb. 7, 1978, Fukuoka disclosed ventilated footwear comprising an outer sole having a hollow portion forming an air pumping chamber at its heel portion, a plurality of ventilation holes provided on an inner sole within the range of the air pumping chamber, a cushioning material having cells therein to contain air being spread over an upper surface of the inner sole on the heel part thereof, projections projecting from the outer sole forming cavities between the outer sole and the inner sole, the cavities functioning as an air chamber, a plurality of ventilation holes provided on the inner sole and ducts longitudinally provided between the inner sole and the outer sole so as to communicate the air pumping chamber and the cavities. When the weight of the wearer is applied to the heel part, the ventilation holes are closed and the cushioning material is depressed so as to forcibly send air from the chamber to the cavities through the ducts and when the weight of the wearer is applied to the front area of the shoe, the projections are depressed and deformed so as to force air into the inner part of the shoe through the ventilation holes.

In U.S. Pat. No. 5,068,981, dated Dec. 3, 1991, Jung disclosed a self-ventilating device for a shoe insole, which includes a heel chamber body having a spring disposed therein, an inlet valve having a plurality of sole aperture for communicating with a plurality of channels in the sole portion of the shoe insole, and a pair of outlet valves disposed in both side walls thereof for communicating to the atmosphere, whereby when each step is taken by the shoe user, a moisture and odor waste quantity of air is forced from the channels in the sole portion through the inlet valve to the heel chamber body when the pair of outlet valves are closed and expelled through the pair of outlet valves to the atmosphere automatically when the inlet valve is closed.

In U.S. Pat. No. 5,619,809, dated Apr. 15, 1997, Sessa disclosed a footwear sole assembly for providing air circulation around the foot and also providing improved resilient cushioning. The assembly includes an outsole and an insert suspended above the outsole in trampoline-like fashion to define an air chamber therebetween. As the wearer strides, the insert moves toward the outsole compressing the air contained in the air chamber and causing that air to flow onto the foot through the apertures in the insert. Preferably, the outsole defines a plurality of upwardly opening pockets, and the insert includes a plurality of downwardly extending pins aligned with the pockets. The flexing action of the insert also drives the pins down into the pockets where they are deformed to absorb the impact of the stride.

In U.S. Pat. No. 5,746,013, dated May 5, 1998, Fay, Sr. disclosed a conventional shoe which comprises a shoe upper of continuous and uninterrupted material attached to an outer sole which has its shoe upper lined with an air-cooled, treatable shoe liner comprising an outer knit layer of hydrophilic material, an inner knit layer of hydrophobic material, and monofilament yarns of hydrophobic material extending between and interknitted with the outer and inner layers for maintaining an air chamber therebetween, such that moisture from the foot of the wearer is transmitted by the inner layer and the monofilament yarns through the air chamber and is absorbed by the outer layer and passes into the shoe upper to be dried by the outer air.

In U.S. Pat. No. 4,215,492, dated Aug. 5, 1980, Sandmeier disclosed a ventilating insole for use in a shoe in which the same includes an interior chamber for the forced flow of air unobstructed and uninterruptedly between the heel and toe portions thereof and through inlet and outlet openings.

In U.S. Pat. No. 4,776,110, dated Oct. 11, 1988, Shiang disclosed an insole-ventilating shoe which includes: an insole having an air pumping device formed on a rear portion of the insole having an air guide protruding upwardly to exchange fresh air outside the shoe vamp, and plural ventilating grooves with through holes formed on a front portion of the insole for circulating air from the pumping device in the insole and shoe for comforting a wearer's foot.

In U.S. Pat. No. 3,973,336, dated Aug. 10, 1976, Ahn disclosed a shoe having ventilating means for supplying fresh air to the interior of the shoe which has a base sole and an inner bottom sole defining between them an air distributing chamber and a space for accommodating an air supplying chamber to the rear of the air distributing chamber. The inner sole has an aperture therein between the air distributing chamber and the interior of the shoe for passing air from the air distributing chamber to the interior of the shoe. A collapsible resilient air supplying chamber is provided in the space for accommodating the air supplying chamber and having an air distributing conduit extending therefrom into the air distributing chamber and having an air intake conduit extending thereinto from outside of the shoe. Counterflow preventing valve means are provided in each conduit, and a rigid press member has a forward end anchored in one of the soles and has the rear end extending into the space for accommodating the air supplying chamber above the air supplying chamber. When a wearer in walking in the shoe raises the rear part of the shoe, the air supplying chamber is pressed against the press member for pumping the air supplying chamber into the air distributing chamber and thence into the interior of the shoe, and when the rear part of the shoe is lowered and the air supplying chamber regains its initial shape, fresh air is induced into the air supplying chamber through the air intake conduit.

In U.S. Pat. No. 5,175,946, dated Jan. 5, 1993, Tsai disclosed an insole which includes a heel portion defining a recess. A replaceable pneumatic buffer defining a first and a second tubular elements is received in the recess of the insole. A central tunnel communicating with the first tubular element defines a hole. A plurality of tunnels communicate the first tubular element with the second tubular element. When load is exerted on the buffer, the second tubular element abuts a surface of the shoe, thereby defining a chamber filled with air. When the load increases excessively, air is ventable through the hole of the central tunnel and further off the chamber.

In U.S. Pat. No. 5,224,277, dated Jul. 6, 1993, Sang Do disclosed a footwear sole which has a waterproof ventilation part secured in the midsole or the outsole, and a horseshoe-shaped shock-absorbing heel member secured in the heel portion of the sole part in which the waterproof and ventilation part is secured. The waterproof and ventilation part includes a buoyancy plate that blocks penetration of water into the sole during bad weather. The shock-absorbing heel member has opposite flanges with an empty space therebetween that insure very good shock-absorbing properties of the shock-absorbing heel member.

In U.S. Pat. No. 5,408,760, dated Apr. 25, 1995, Tse, et al., disclosed a shoe which is provided with an air pumping device capable of supplying fresh air from the ambient atmosphere into the interior of the shoe. The air pumping device is detachable from the shoe so that it can be cleaned to remove dirt or alien objects that may block the air flow path. The air pumping device is located beneath the forepart of a foot wearing the shoe. When the user makes a step forward, an air bag is compressed at the instant the forepart of the foot is bent to lift the heel off the ground, thereby generating an air pumping action. When the forepart of the foot stretches straight again, the air bag restores to its original shape, thereby generating an air sucking action. As the user keeps moving, the air pumping device will pump air successively from the ambient atmosphere into the interior of the shoe. The air flow direction may be reversed so as to pump air inside the shoe out to the ambient atmosphere.

In U.S. Pat. No. 4,420,893, dated Dec. 20, 1983, Stephan disclosed a system for supplying air to the interior of a shoe, particularly of a skiing boot for Alpine skiing. The shoe or skiing boot comprises a shell and a gaiter, which is pivoted to the shell and pivotally movable in the longitudinal direction of the shoe. An air-handling device is mounted on the shell of the sole and is connected to actuating means. The latter is also connected to the gaiter and during a forward and rearward pivotal movement of the gaiter move up and down to impart a pumping motion to the air-handling device so that air is pumped into the interior of the shoe. The air inlet is preferably disposed near the sole of the shoe.

While these shoe insole devices may be suitable for the purposes for which they were designed, they would not be as suitable for the purposes of the present invention, as hereinafter described.

SUMMARY OF THE INVENTION

The present invention discloses a device for a shoe insole having multiple layers which form an air circulation system. A first layer is a fabric-like covering, a non-deformable second and deformable third layers forming together a layer with a cavity therein having offset apertures therein communicating by means of the cavity positioned underneath the fabric-like covering; a fourth layer made of foam rubber like material that deflates under the user's weight and re-expands when not under the user's weight; a bottom layer being a stiffer layer that forms a recess for receiving the other layers. A first and second exhaust conduit is formed in a side extension area for outward passage of stale air. The layers are joined to each other and the device is then inserted into the shoe of the user. The weight of the user is alternatively placed on and removed from the insole while walking or running. When the weight of the user is on the insole it compresses and stale air is forced out the exhaust conduit. When the weight of the user is removed from the insole, the foam rubber layer seeks to expand and therefore creates a vacuum which pulls air through the apertures of the second and third layers as the deformable third layer is deposed toward the foam rubber layer.

An object of the present invention is to provide fresh air into the insole in order to expel the stagnant air therefrom. An additional object is to remove and reduce foot odor. Another object is to help prevent wet or sweaty feet that might cause colds and to further promote the comfort of the user. Further, the present invention provides a soft cushion for added foot comfort for the user.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
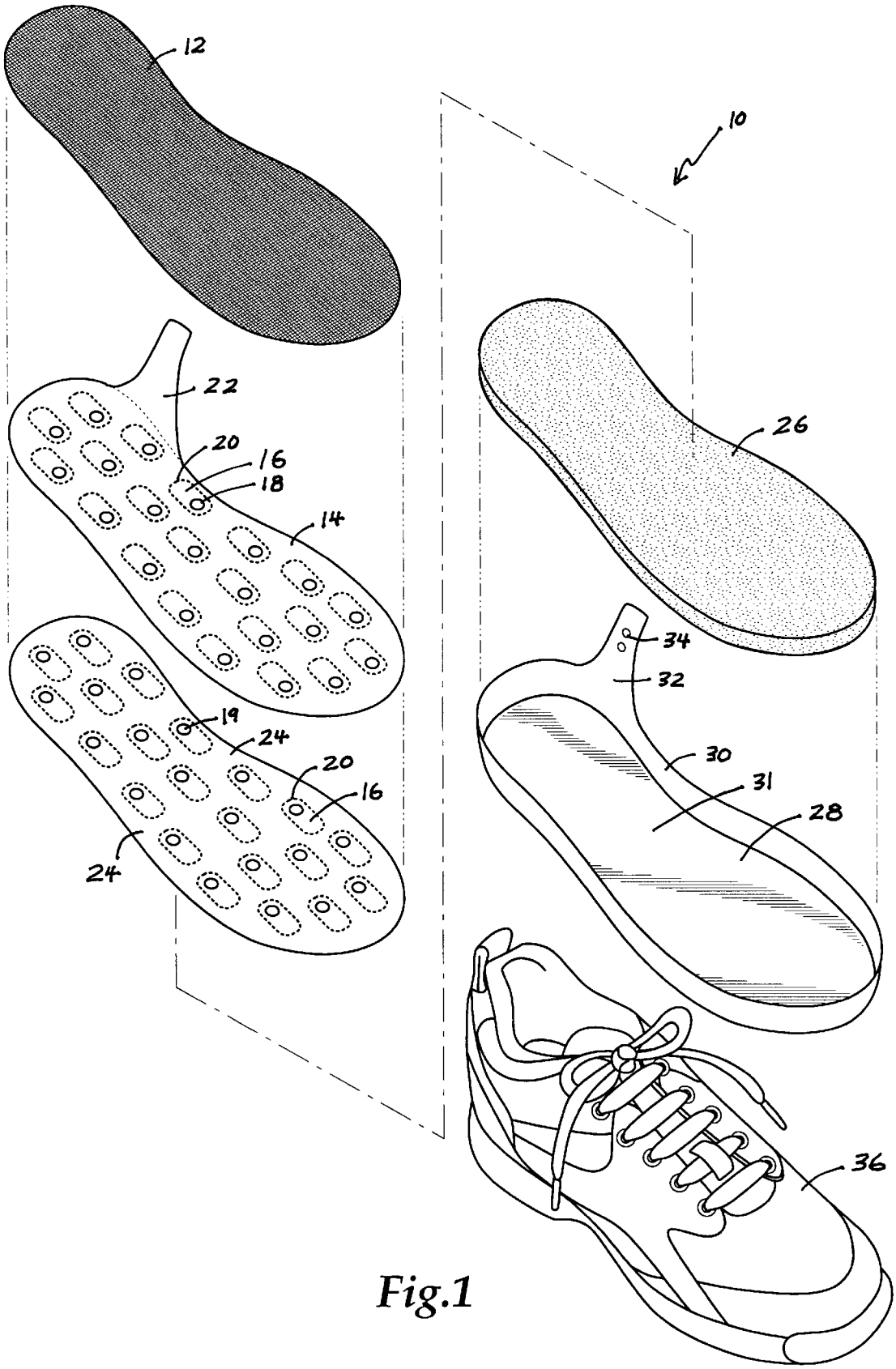
FIG. 1 is an exploded view of the present invention.

With regard to reference numerals used, the following numbering is used throughout the drawings.

10 present invention
12 first fabric layer
14 second layer
16 cavity
18 aperture
19 aperture
20 extremities of valve cavity
22 side extension
24 third layer
26 fourth foam rubber layer
28 fifth bottom layer
30 wall of bottom layer
31 recess
32 side extension
34 extension aperture
36 outer side tab layer
38 means for attachment
40 means for attachment
42 inner exhaust conduit
44 outer exhaust conduit
46 downward pressure
48 downward pressure removed

DESCRIPTION OF THE PREFERRED EMBODIMENT(S)

Turning now descriptively to the drawings, in which similar reference characters denote similar elements throughout the several views, FIGS. 1 through 8 illustrate the present invention being a shoe insole having multiple layers in order to incorporate an air circulation system.

Turning to FIG. 1, therein is shown an exploded view of the components of the present invention generally shown at 10. Shown therein is a first layer being a breathable fabric-like layer 12 which serves to cover the underlying multiple layered insole and to separate it and to protect it from the foot of the user and to prevent the entrance of foreign particles such as dirt and debris from entering or penetrating the underlying layers. Also shown is non-deformable layer 14 which shows the designated areas which will become valve cavities 16 with the heavy dotted lines 20 representing the extremities of the glue, heated or ultra-sonic weldments or joinder between the layers that create the plurality of valve cavities 16 after the layers 14 and 24 are joined together. The generally horizontal cavities 16 are spaced entirely about the insole 10 so as to provide ventilation over the entire insole. Cavity 16 provide an air conduit between apertures 18 and 19. The heavy dotted lines do not represent hidden lines in the conventional drafting sense but the extremities of cavities 16 after joinder of layers 14 and 24. Also shown is the generally upstanding extension 22 on the side of the layer 14 which will be further described hereinafter. Next is shown another layer 24 similar to layer 14 having the items as previously discussed except that it does not contain the extension 22 and is a soft deformable plastic or rubber layer. The next layer 26 is a soft, cushion-like, springy rubber resiliently deformable layer 26 which is made of foam rubber or the like. The next layer 28 is the layer that forms a semi-enclosure around the other layers being a non-breathable layer. Also shown is a peripheral wall 30 which forms cL recessed area 31 therein for receiving the overlying layers 12, 14, 24 and 26 along with its generally upstanding side extension 32 having at least one aperture 34 therein which allows outward passage of air. Also shown at 36 is a conventional tennis shoe within which the present invention 10 can be fitted. The present invention 10 is contoured and shaped to fit within a left and right shoe.

Figure 2:
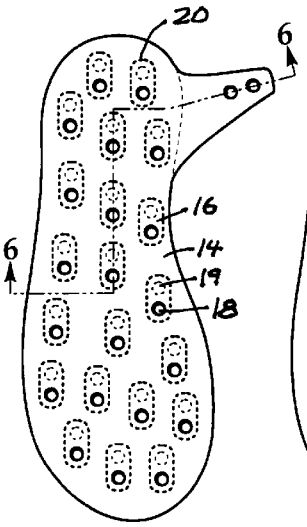
FIG. 2 is a plan view of the present invention partially assembled.

Turning to FIG. 2, therein is shown a plan view of the invention 36 completely assembled except that fabric layer 12 is not shown. The heavy dotted lines 20 are not hidden lines but represent the extremities of glue or ultra-sonic weldments between layers 14 and 24 that form the generally horizontal cavities 16. Layers 14 and 24 are joined together over their entire contiguous surfaces by glue or other means, except inside the areas or cavities 16 defined by heavy dotted lines 20. Note that communicating apertures 18 and 19 are offset from each other within cavity 16 with aperture 18 located in front of aperture 19 as will be described hereinafter, Apertures 18 and 19 could be offset from each other in any direction not just front to rear.

Figure 3:
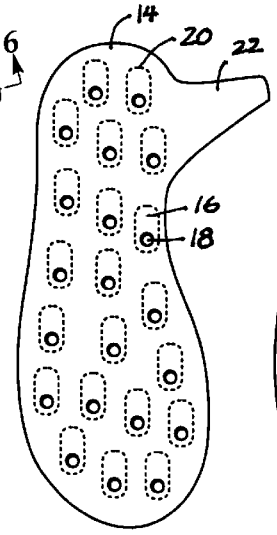
FIG. 3 is a plan view of a layer of the present invention.

Turning to FIG. 3, therein is shown a plan view of layer 14 showing the features as previously described. This layer 14 is effectively non-deformable, and is expected to be a harder plastic-like or rubber-like layer. Layer 14 shows the designated areas which will become valve cavities 16, with the heavy dotted lines 20 representing the extremities of the glue, heated or ultra-sonic weldments or joinder between the layers that create the plurality of valve cavities 16 after the layers 14 and 24 are joined together. The generally horizontal cavities 16 are spaced entirely about over the entire surface of the insole 10 so as to provide ventilation over the entire insole. Cavity 16 provide in air conduit between apertures 18 and 19. The heavy dotted lines do not represent hidden lines in the conventional drafting sense but the extremities of cavities 16 after joinder of layers 14 and 24. Also shown is extension 22 on the side of the layer 14 which will be further described hereinafter.

Figure 4:
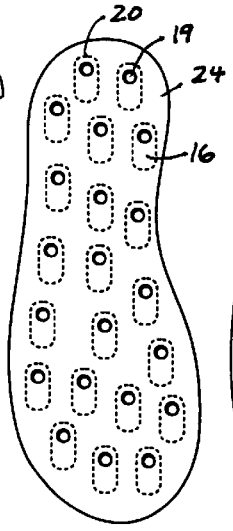
FIG. 4 is a plan view of a layer of the present invention.

Turning to FIG. 4, therein is shown a plan view of layer 24 showing the features as previously described except that it does not have side extension 22. This layer 24 is expected be a softer, thinner rubber-like layer which is effectively deformable under pressure of layer 26 seeking to re-expand from the compressed state as can be seen in FIG. 8. Apertures 19 communicate with apertures 18 by means of cavity 16 whereby air passage is allowed. Cavity 16 acts like a valve in the sense that the air conduit of cavity 16 is shut as can be seen in FIGS. 6 and 7, and is open as can be seen in FIG. 8.

Figure 5:
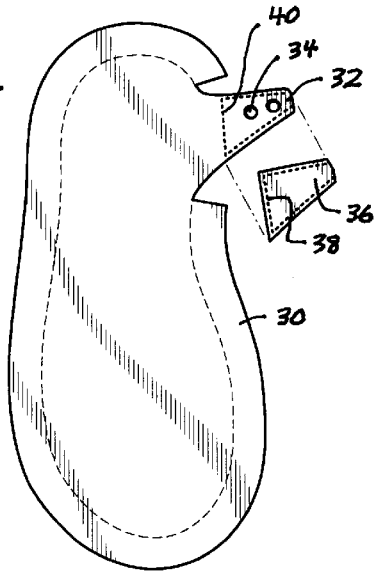
FIG. 5 is a plan view of a layer of the present invention.

Turning to FIG. 5, therein is shown a plan view of layer 28 showing the features as previously described. This non-breathable layer is expected to be a soft, rubber bottom layer and cups the foam rubber and creates the vacuum inducing lower cavity. Also shown is side tab 36 which is a patch-like member made of material similar to layer 28 and has means for attachment 38 along its periphery to side extension 32 at 40 which means could be glued or sewn as would be done in the standard manner by one skilled in the art. Layer 28 is the layer that forms a semi-enclosure around the other layers being a nonbreathable layer. Also shown is a peripheral wall 30 which forms a recessed area 31 therein for receiving the overlying layers 12, 14, 24 and 26 along with its side extension 32 having at least one aperture 34 therein which allows outward passage of air.

Figure 6:
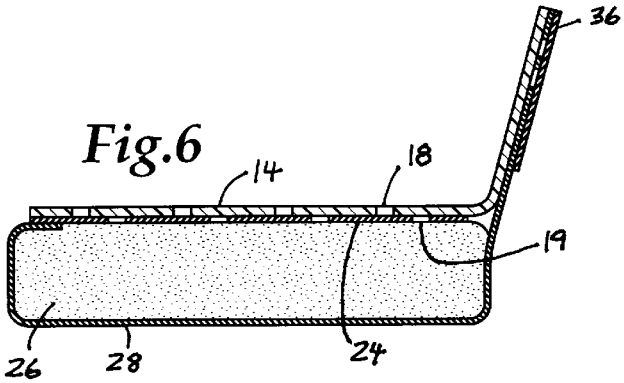
FIG. 6 is a cross-sectional view taken from FIG. 2 as indicated, showing the present invention.

Turning to FIG. 6, therein is shown a cross-sectional view taken from FIG. 2 as indicated showing the present invention at rest with no pressure on any of the layers. As can be seen, the foam rubber layer is completely expanded thereby indicating that it is full of air and has no pressure on it. Also note that the valve cavities and layer 24 particularly are laying flat with layer 18 and 24 contiguous to each other indicating that no air is passing therebetween because no air conduit exists between apertures 18 and 19 since cavity 16 is flat.

Figure 7:
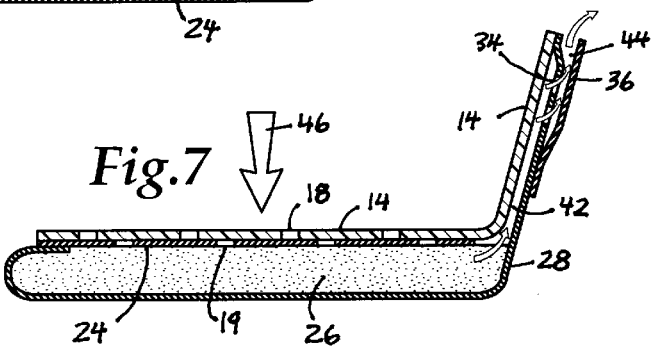
FIG. 7 is a cross-sectional view taken from FIG. 2 similar to FIG. 6, showing the present invention in operation.
Figure 8:
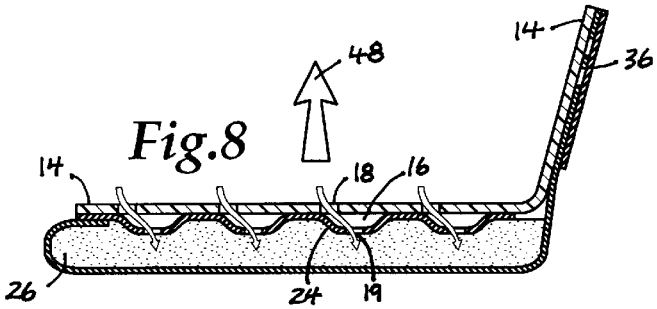
FIG. 8 is a cross-sectional view taken from FIG. 2 similar to FIG. 6, showing the present invention in operation.

Turning to FIG. 7, therein is shown a cross-sectional view of the present invention similar to FIG. 6 showing the hypothetical results of downward pressure 46 of a foot pushing on the insole 14 expelling the stale air out through the side apertures 34 and out of the insole. A first inner exhaust port or conduit 42 forms between layers 14 and 28, and a second outer exhaust port 44 forms between layers 29 and 36 due to air being forced out of layer 26 due to the downward pressure. Air is forced out exhaust conduit 42 through aperture 34 and exhaust port 44 because layer 24 being deformable is pressed and thereby sealed against layer 14 causing cavity 16 to flatten so that air cannot pass between apertures 18 and 19. This also demonstrates the importance of apertures 18 and 19 being offset so that air cannot pass between them in this situation as would occur if the were aligned.

Turning to FIG. 8, therein is shown a cross-sectional view of the present invention similar to FIG. 6 showing the hypothetical results of the pressure 48 of a foot having been removed from the insole causing the side valves 36 to snap shut, and the cavity valves 16 open under the influence of the newly created vacuum in the lower layer cavity 26. The soft, deformable layer 24 is movably deposed slightly away from layer 14 toward foam rubber layer 26 thereby allowing the cavities 16 to open and form thereby allowing air to flow through apertures 18 and 19 into foam rubber layer 26 thereby replenishing the air supply in layer 26 effectively sufficient for the next downward cycle as shown in FIG. 7 to be repeated. Layer 14 is effectively rigid to prevent it from being deposed toward layer 26 which, if it occurred, would impede the flow of air between apertures 18 and 19 during this cycle shown in FIG. 8. The vacuum caused by layer 26 seeking to expand from the compressed state and to regain its internal air supply caused layers 28 and 36 to collapse onto layer 14 thereby closing exhaust port 42 and 44 so that air can no longer flow through extension aperture 34 which forces air to flow through apertures 18 and 19.

It is expected that the layers of the present invention would be joined together as would be done in the standard manner by one skilled in the art which could include gluing, heating or ultra-sonic weldments. The materials of construction would be chosen in the standard manner by one skilled in the art.

What is claimed to be new and desired to be protected by Letters Patent is set forth in the claims:

1. An apparatus for a shoe insole, comprising:

a) a first upper fabric layer for protecting the underlying layers;

b) a second layer having a plurality of aperture therein for the passage of air;

c) a third layer having a plurality of apertures therein for the passage of air;

d) said apertures of said second layer and said third layer being offset from each other;

e) a fourth foam rubber layer;

f) a fifth bottom layer forming a partial enclosure for all other layers; and, g) means for attaching the layers to each other.

2. The apparatus of claim 1, further comprising said second layer and said third layer having a plurality of cavities formed therein between, said cavities formed by the joinder of said second layer to said third layer, said cavities being spaced about, said cavities being generally horizontal, whereby air is transferred through said apertures of said second layer and said apertures of said third layer.

3. The apparatus of claim 2, further comprising said cavities being formed by means for deformation of said third layer toward said fourth layer due to suction from said fourth layer as said fourth layer re-expands following compression.

4. The apparatus of claim 1, wherein said first layer is breathable.

5. The apparatus of claim 1, wherein said second layer being non-deformable material, wherein said third layer being deformable material.

6. The apparatus of claim 1, said fifth layer further comprising a peripheral wall having a recessed area therein for receiving said first, second, third and fourth layers.

7. The apparatus of claim 1, further comprising said second layer having a generally upstanding side extension, said fifth layer having a generally upstanding side extension, said side extension of said fifth layer having an aperture therein, an outer side tab layer attached to the outer surface of said side extension of said fifth layer, whereby an exhaust conduit is formed.

8. The apparatus of claim 7, further comprising a first exhaust conduit between said second and said fifth layer for the outward passage of air, a second exhaust conduit between said fifth layer and said outer side tab layer for the outward passage of air, whereby an exhaust port is formed.

9. The apparatus of claim 5, wherein said third layer being effectively deformable in response to air pressure exerted on said third layer by said fourth layer expanding from a compressed condition.

10. The apparatus of claim 5, wherein said second layer being effectively non-deformable in response to air pressure exerted on said second layer by said fourth layer expanding from a compressed condition.

11. The apparatus of claim 1, said means for attaching further comprising glue.

12. The apparatus of claim 1, said means for attaching further comprising ultra-sonic weldments.

13. The apparatus of claim 1, said means for attaching further comprising heat.

* * * * *